United States Patent [19]

Perini

[11] 4,327,877

[45] May 4, 1982

[54] WINDING DEVICE

[76] Inventor: Fabio Perini, Via della Fornace, S. Michele di Moriano, Lucca, Italy

[21] Appl. No.: 186,002

[22] Filed: Sep. 10, 1980

[30] Foreign Application Priority Data

Sep. 21, 1979 [IT] Italy ..... 9543 A/79

[51] Int. Cl.[3] ..... B65H 17/12; B65H 75/28

[52] U.S. Cl. ..... 242/66; 242/74

[58] Field of Search ..... 242/66, 56 R, 67.1 R, 242/74

[56] References Cited

U.S. PATENT DOCUMENTS

| | | | |
|---|---|---|---|
| 2,676,764 | 4/1954 | Aulen | 242/66 X |
| 3,817,467 | 6/1974 | Dambroth | 242/66 |
| 3,910,517 | 10/1975 | Harrison | 242/66 |
| 4,133,495 | 1/1979 | Dowd | 242/66 |

FOREIGN PATENT DOCUMENTS

| | | | |
|---|---|---|---|
| 1435525 | 5/1976 | United Kingdom | 242/66 |

*Primary Examiner*—Edward J. McCarthy
*Attorney, Agent, or Firm*—McGlew and Tuttle

[57] ABSTRACT

A continuous winding device for webs of paper, such as toilet paper, comprises a first drum which is drivable at a peripheral speed equal to the speed at which the material to be wound is fed during the winding phase, and a second drum spaced from the first by a distance corresponding to the diameter of winding cores for the formation of spools of the material. The second drum is driven at a peripheral speed equal to that of the first, and to that of the material being guided along the second drum. A mechanism for temporarily varying the speed of the first drum during a phase of core replacement and for tearing the material is provided as is a mechanism for inserting a core between the two drums. A displaceable presser drum is also used which bears against the spool being formed and thus holds the spool between the two first and second drums and the presser drum during winding. The device includes, the first drum, annular seats with perforated zones, for receiving suction orifices adapted to exert a suction force during the removal of the finished roll and insertion of a new core. The material is thus brought to the zone in which the tearing is to take place, and the material is securely inserted between the drum and the new core.

12 Claims, 11 Drawing Figures

60
N
10
4
9
7
5
50
48
RF
3
16
20
14
12
18
A2
18A
30
46
44
32
22
1

Fig.9
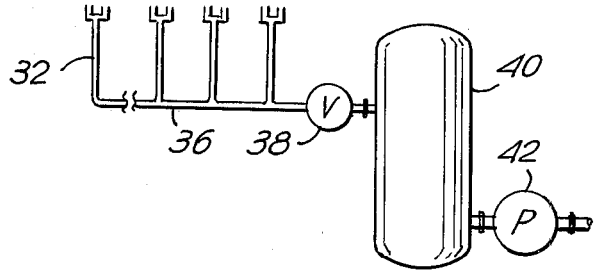
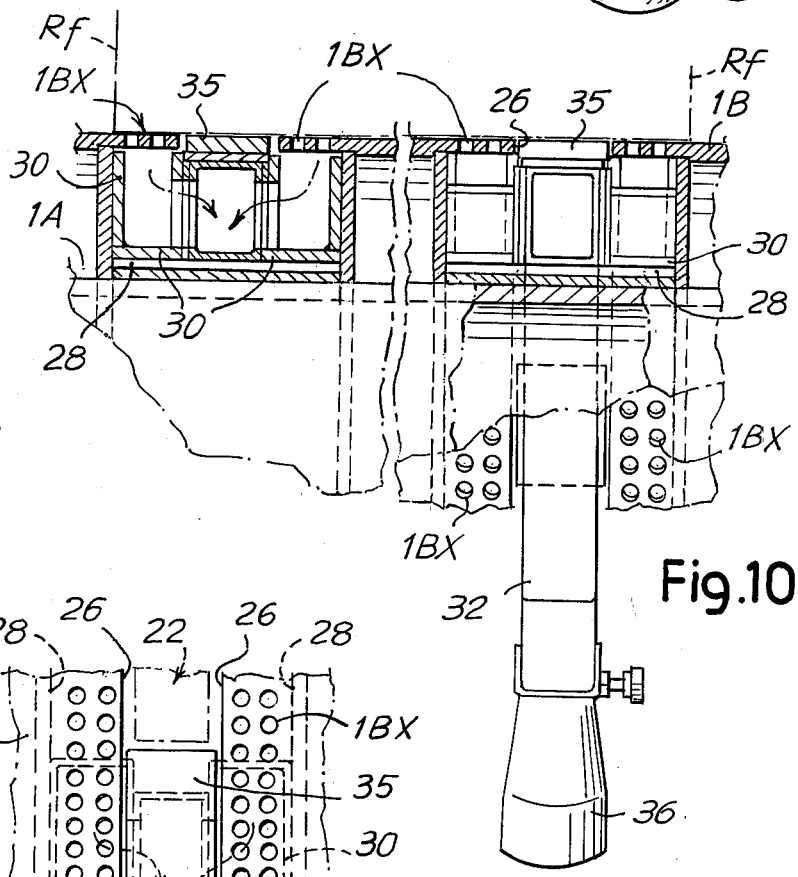
Fig.10
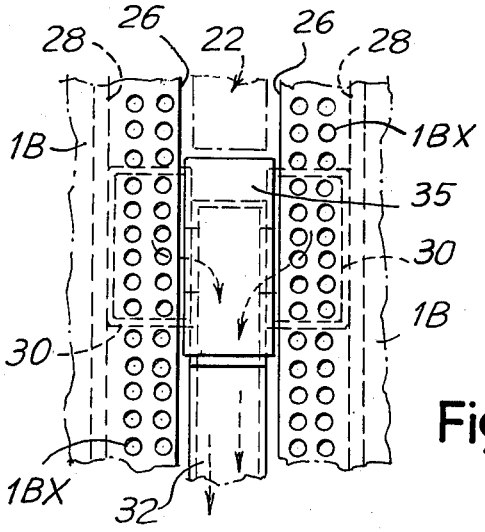
Fig.11

WINDING DEVICE

FIELD AND BACKGROUND OF THE INVENTION

The present invention relates in general to winding devices and in particular to a new and useful winding device for webs of paper of great length, for the production of toilet paper rolls or the like. The device is designed to ensure a continuous and uniform movement of the ribbon type material also during the phase of insertion of a new core to start the formation of another spool or "stick" of wound material. The device permits using tabular cores of cardboard or the like without the presence of reinforcement mandrels, and it assures proper separation of the wound material from that which is to be wound on the new core for the formation of the next spool. The inventive device also assures the removal of the stick or roll which has already been formed.

SUMMARY OF THE INVENTION

An object of the present invention is to provide a continuous winding device for webs of paper such as toilet paper, etc., comprising first drum drivable at a peripheral speed equal to the speed at which the material to be wound is fed during the winding phase, a second drum spaced from the first by a distance corresponding to the diameter of the winding cores of the material for the formation of the spools or sticks, with the second drum being driven at a peripheral speed equal to that of the first, and the material being guided along the second drum. Means for temporarily varying the speed of the first drum during the phase of core replacement and for tearing the material is provided as are means for inserting a core between the two drums. A displaceable presser drum, which bears against the spool or stick being formed and thus holds the stick between the first and second drums and the presser drum during the winding, is also utilized.

According to the invention, the improved device comprises, in said first drum, annular seats with perforated zones, receiving suction orifices adapted to exert a suction during the phase of removal of the finished roll and insertion of a new core for bringing the material into the zone in which the tearing is to take place, and for inserting the material between the drum and the new inserted core.

Advantageously, the means for inserting a core between the first and second drums comprise elements protruding into the annular seats to interfere with the surface of the drum and thus to facilitate the winding of the starting end of the paper on the new core just inserted. These elements are formed by continuous belts adapted to make contact with the core along sections comprised between guide wells, to insert the core which is rolling with it. The belts are taken along by the newly inserted core and set in rotation between the drums,, or are themselves driven in its rotation.

The first drum may have annular channels partially covered by perforated lips, which delimit gaps from which issue suction ducts connected to the suction orifices, which are received in the channels. Also, the belts penetrate into these gaps.

Another object of the present invention is to provide a winding device which is simple in design, rugged in construction and economical to manufacture.

Another object of the invention is to provide a method of winding a web of material on a core comprising supplying a web to a core, rotating the core between two drums which are rotated at a peripheral speed substantially the same as the speed at which the web is supplied, guiding the web around the core to form a roll of web on the core, slowing the rotation of one of the drums to advance the roll, feeding a new core to between the rollers and toward the web, and carrying the web between the roll and the new core.

A further object of the invention is to provide such a method wherein the web between the roll and the new core is attracted to the drum which is slowed in rotation by suction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 9 is a schematic diagram of a pneumatic suction system used in accordance with the invention;

FIG. 10 is a sectional view partly in elevation of a first drum of the invention including suction orifices; and FIG. 11 is a partial top plan view of the details shown in FIG. 10.

DESCRIPTION OF THE PREFERRED EMBODIMENTS

Figure 1:
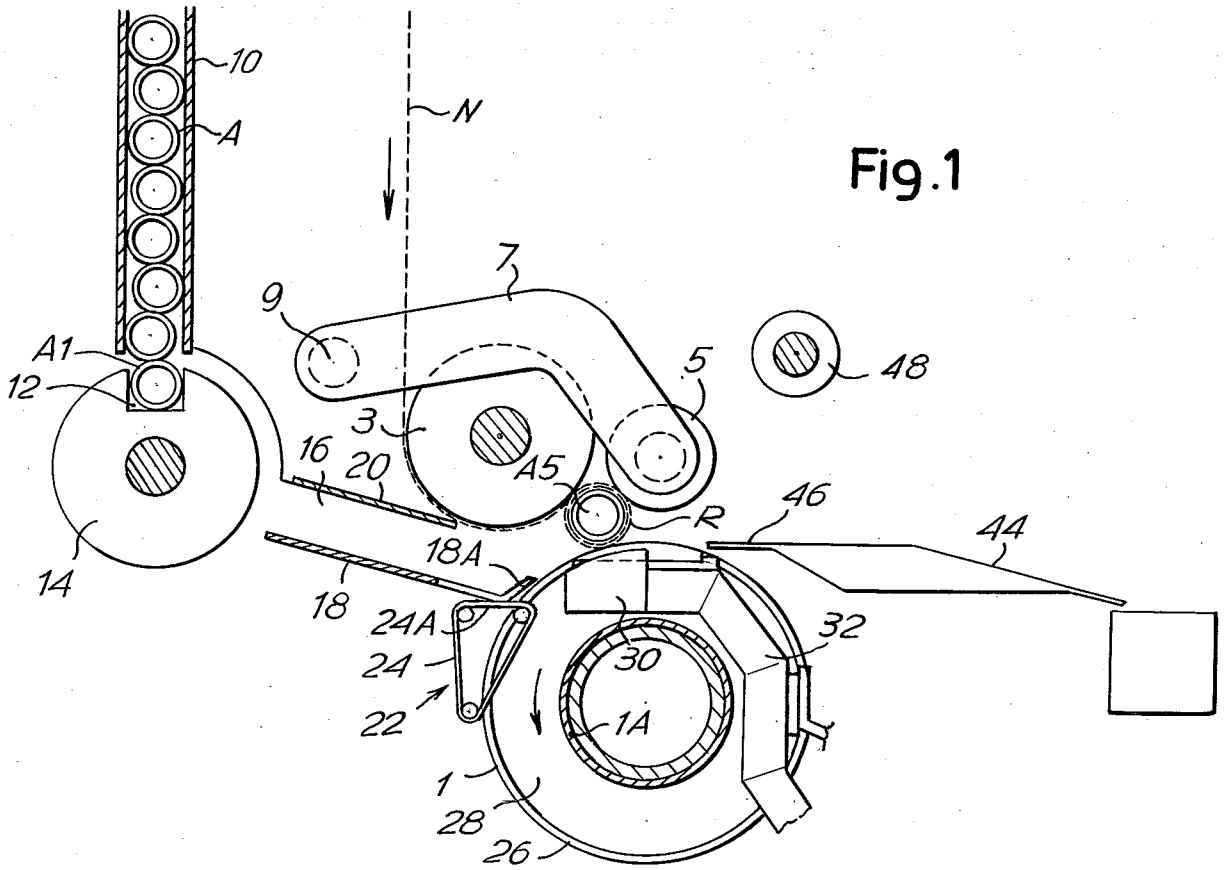
FIGS. 1 through 8 are schematic, sequential, side elevational views of the winding device according to the invention shown in several positions or phases of operation.

As illustrated in the annexed drawings, a first lower rotating drum 1 is provided which, for most of a spool forming cycle, rotates at a peripheral speed corresponding to that at which a web N of material is fed. A second upper drum 3 is spaced from the lower drum 1 by a distance substantially corresponding to the diameter of a tubular cores A, which must be fed, one after the other, between the two drums in the manner indicated below. Drum 3 rotates at a peripheral speed equal to that of the web N. A presser drum 5 is provided which also has a peripheral speed corresponding to the speed at which the web N is fed. The presser drum 5 is carried by arms 7, articulated at pivot point 9 in such a way that it can rise progressively as the roll of paper is being formed and its diameter increases.

A magazine 10 is provided to feed the cores A in which the cores are stored and superposed one on the other and arranged so that a core A1 can be fed in a longitudinal seat 12 of a shunt 14, formed by a rig rolling on an axis parallel to that of the cores and of the seat 12, to move core A1 from the filling position under magazine 10 to a position at a channel 16, defined by a chute 18 and by an upper wall 20. Chute 18 is made at least in part as a grate, for the purpose indicated below, and terminates with a part 18A which constitutes a saddle type seat for a core A2 (see FIG. 2), which must stop there before being inserted between the two drums 1 and 3 and begin the winding of the web. The shunt 14 may be provided with a single seat 12 and be displaced alternately between the two filling and delivery positions in channel 16, or it may be provided with one or more seats and be rotated in each cycle by a predetermined angle. The shunt or inserter means 14 may be replaced by a box inserter.

At and below chute 18, which, as has been said, is made as a grate at least in the lower part, there is provided a pushing rig or means 22, which comprises a plurality of belts 24, each running between three pulleys. The belts are suitably spaced from one another so that they can be inserted in the spaces of between the grate or finger type part of chute 18 in the area of saddle seat 18A. Branch 24A of the belts 24 is active to push a core from position A2 of FIG. 2 to position A3 of FIG. 3 and up to position A4 of FIG. 4. This insertion is actuated by branch 24A of belts 24, in the liner or angular oscillation which the rig 22 describes to move between the position shown in FIG. 1 and the position shown in FIG. 4, in which the active branches 24A of the belts have slightly forced the core to be inserted in the device up to position A4 between the two drums 1 and 3.

The lower drum 1 is formed (see FIGS. 10 and 11) with a central part 1A and an outer mantle 1B which is interrupted by two annular channels 26, whose pitch corresponds to that of the belts 24. At the circumferential channels 26, between mantle 1B and part 1A, annular trenches 28 are formed of a width greater than gaps 26. In each of the trenches 28 a pair of suction orifices 30 can be received, which are connected and fixed to a duct 32 carried by an external structure 36 adjustable angularly coaxially to drum 1. Duct 32 passes through the respective gap 26. The orifices 30 can suck from the outside at grate parts 1BX of the mantle 1 adjacent the gaps 26, the orifices 30 being circumferentially offset relative to the belts 24 of the ring 22. The belts 24 are disposed so as to interfere partially with drum 1, the belts finding support in the gaps 26, in which the gaps corresponding return pulleys are supported. In the zone of the orifices 30, in the respective gap 26, an element 35 is provided shaped to copy the profile of the mantle 1B.

The ducts 32 (see also FIGS. 9 and 10) are connected to a collector 36, which by a valve 38 is brought into communication with a tank under vacuum 40 combined with a pump 42 for creation of the vacuum. Valve 38 is controlled so as to open briefly for the reasons and at the times indicated below, to assure the winding of the starting end of the ribbon-shaped product N on the core just inserted in position A4 of FIG. 4. The pump 42 can be activated to create the vacuum in tank 40 during the entire cycle of winding a stick or spool.

Figure 2:
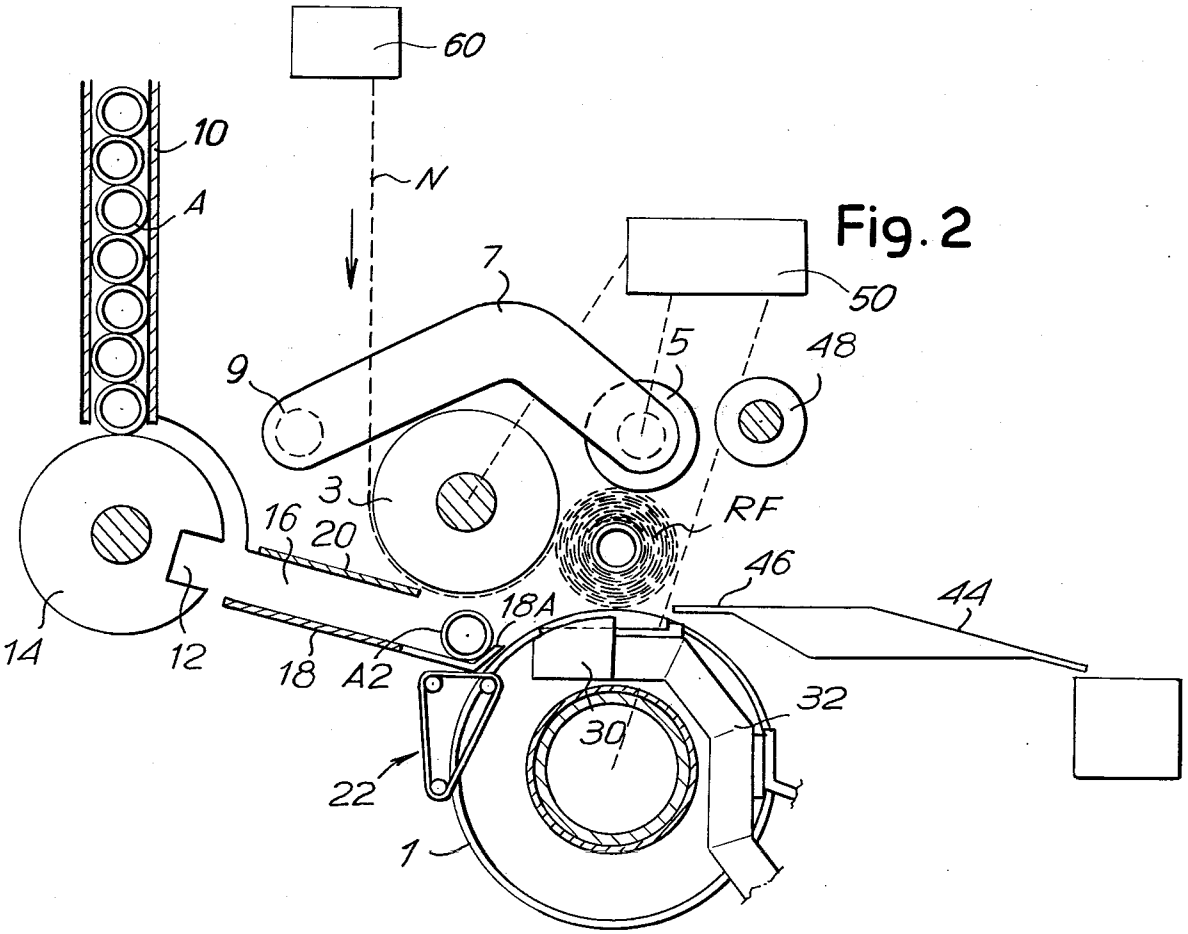

As seen schematically in FIG. 2, drums 1, 3 and 5 are rotated by drive means 50 and web N is fed by feed means 60.

Figure 3:
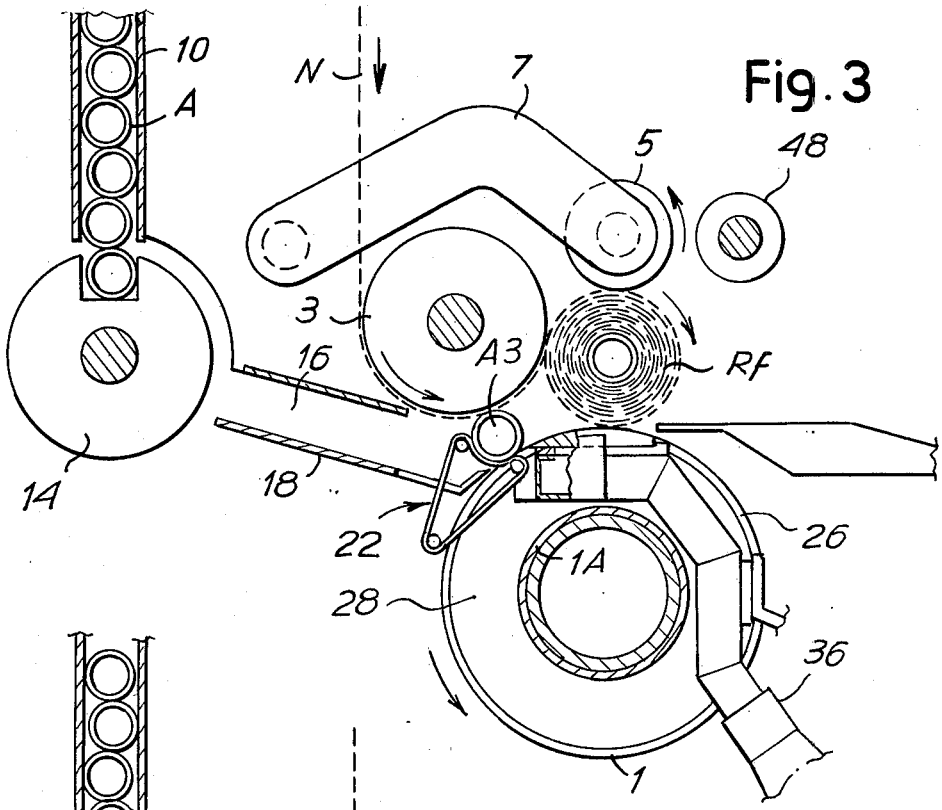
Figure 4:
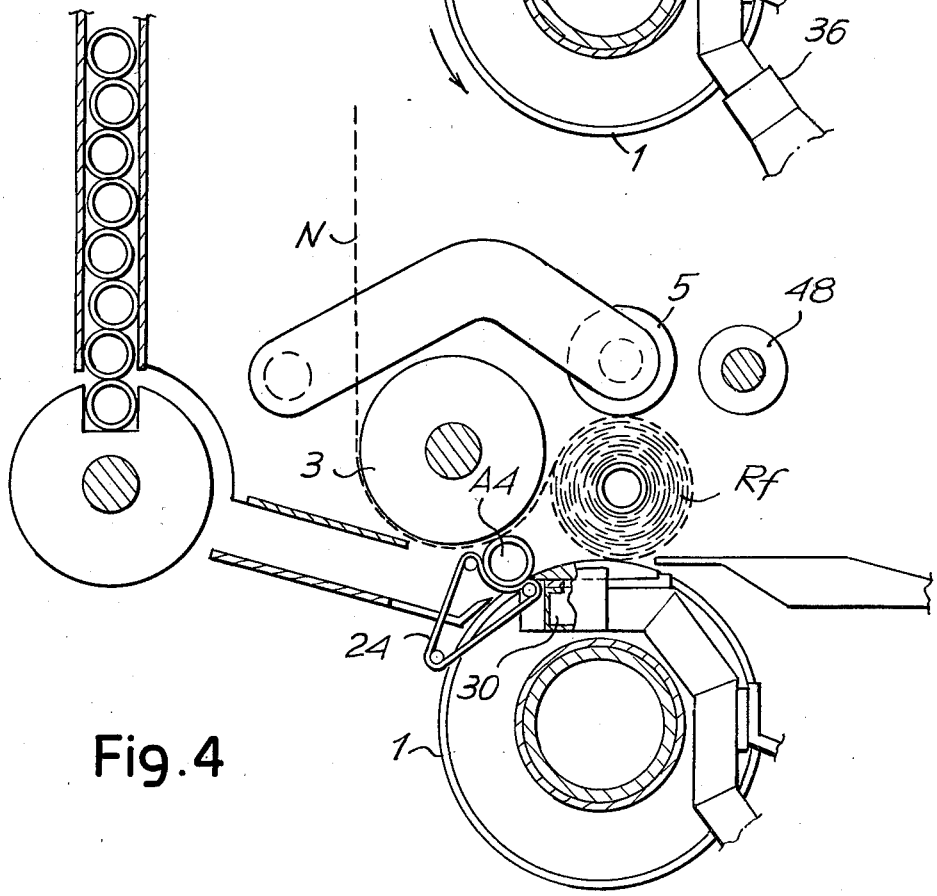
Figure 5:
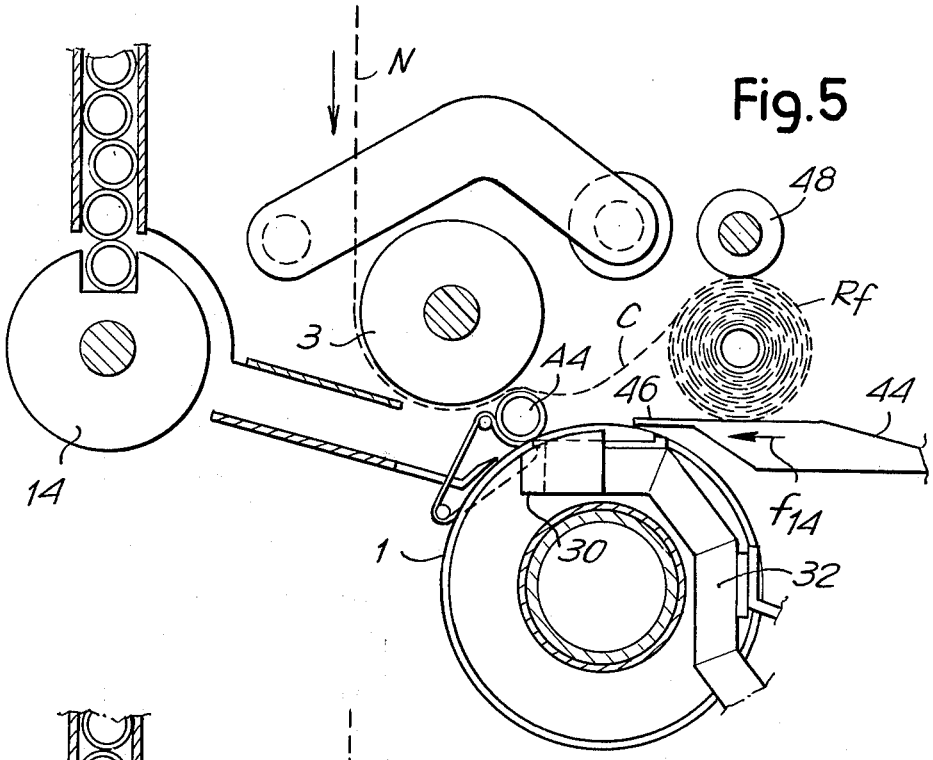
Figure 6:
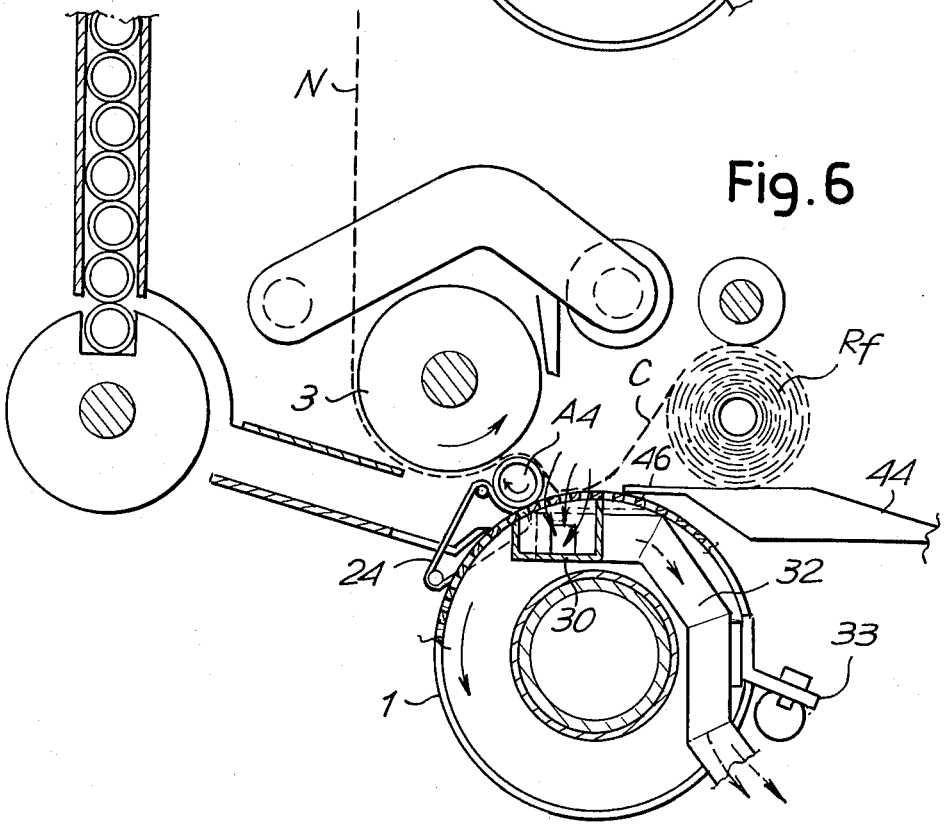
Figure 7:
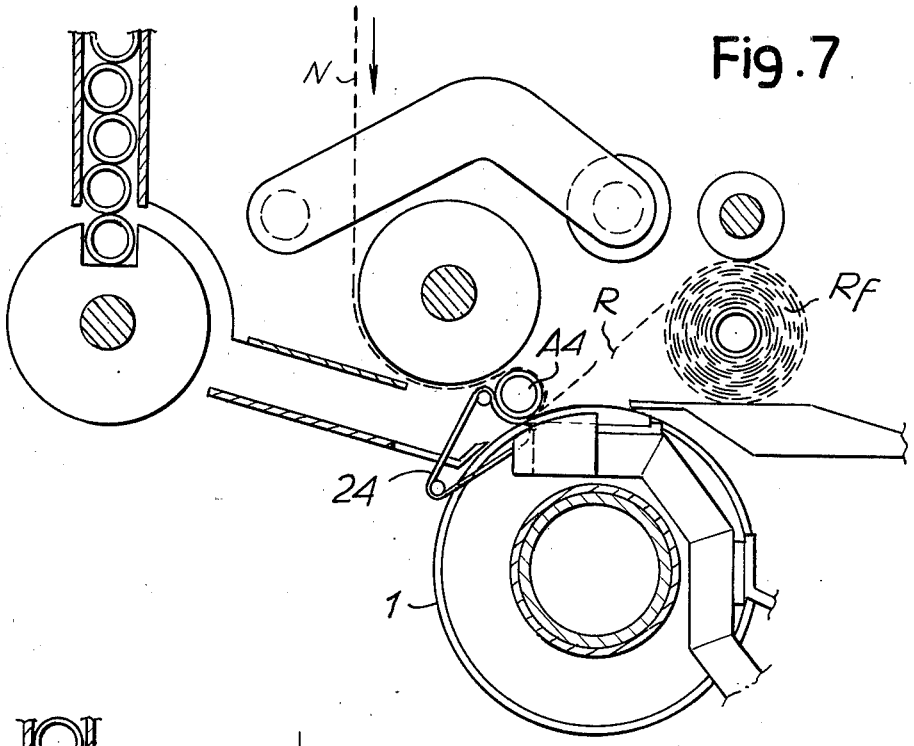

The operation of the device is as follows, considering successively FIGS. 1 to 8:

In FIG. 1 a phase is shown in which on a core A5 the roll R is being formed. The roll R is in contact with the lower drum 1, and with the upper drum 3 and also with the presser drum 5, which are all rotating at a peripheral speed corresponding to that at which the web N is being fed. Web N runs along the arrow of FIG. 1. As the roll increases in diameter, it is displaced, slightly raising the presser drum 5 until it reaches the position indicated by Rf in FIGS. 2 and 3 and beyond this position. During the formation of the roll, the shunt 14 carries a core from position A1 into the channel 16 to make it assume the position A2 shown in FIG. 2. In FIG. 3, the roll Rf has reached its final size, and in this condition the rig 22 of the pusher is displaced from the position of FIG. 1 to the position of FIG. 3 to begin the insertion of the new core which is in position A2, to bring it into position A3. This core initiates rotation as soon as it makes contact between the two drums 1 and 3, and the belts 24 continue the rotation of this core, being taken along by the core or being driven at the speed of the paper. The position of FIG. 4 is thus reached, in which by suitable mechanical electromechanical or pneumatic means, a reduction of the number of revolutions of the lower drum 1 is imposed, to obtain a reduction of the peripheral speed of this drum. This reduction of the peripheral speed advances both the inserted core, which reaches position A4 from position A3 between the two drums 1 and 3, and also a displacement of roll Rf which is brought from the position of FIG. 3 to the position of FIG. 4, rolling in part on the lower drum 1 and being still in contact with the presser drum 5, while the roll Rf loses contact with the upper drum 3. At this point (see FIG. 5) by suitable mechanical means there is abruptly displaced along arrow f14 an element 44 which presents a plane 46 which is inserted between the lower drum 1 and the roll Rf, which thus assumes the position shown in FIG. 5. This position is reached by the fact that the roll Rf is suddenly projected outward, that is, in a direction contrary to the arrow f14, since it is in contact with plane 46 and still in contact with the rotating presser drum 5, and then with a brake drum 48, which brakes the roll Rf in its course. This causes a slowing of the paper C present between the roll Rf and the point of contact between the upper drum 3 and the core in position A4, by effect of the continuous advance of web N along the arrow and around the upper drum 3 which maintains its own continuous rotation. At this point it is already possible that tearing has occurred if valve 38 has been opened and a strong suction is caused through the suction orifices 30. This suction is in the direction of the arrows indicated in FIG. 6. In any case, the free path C of the paper between the roll Rf and the core in position A4, if tearing has not yet taken place, is deformed toward and against the surface of the lower drum 1 at the suction orifices 30. Continuing the rotation of drum 1 (which can resume its normal speed) and of drum 3 according to the speed of feed of the web, the paper C between roll Rf and Core A4 comes to adhere to drum 1 by effect of the suction and then is inserted under core A4, with the result that the slackened limb of paper C assumes a further conformation until it reaches the position shown in FIG. 7 where it is held between core A4 and the lower drum 1, thereby certainly producing the tearing of the paper at a point R between roll Rf and core A4, advantageously at a transverse cutting zone already provided in the paper web N with pitch as required for the finished product. The position of FIG. 7 is thus reached, in which it is clear that the starting end of the web, having separated at point R from the already formed spool Rf, is securely wound on core A4, to which there contribute also the belts 24 which maintain their contact with core A4. After this phase (see FIG. 8) the new winding on core A4 is initiated to initiate the winding of the roll, while the full roll Rf can be removed in any suitable manner, for further manipulations.

Figure 8:
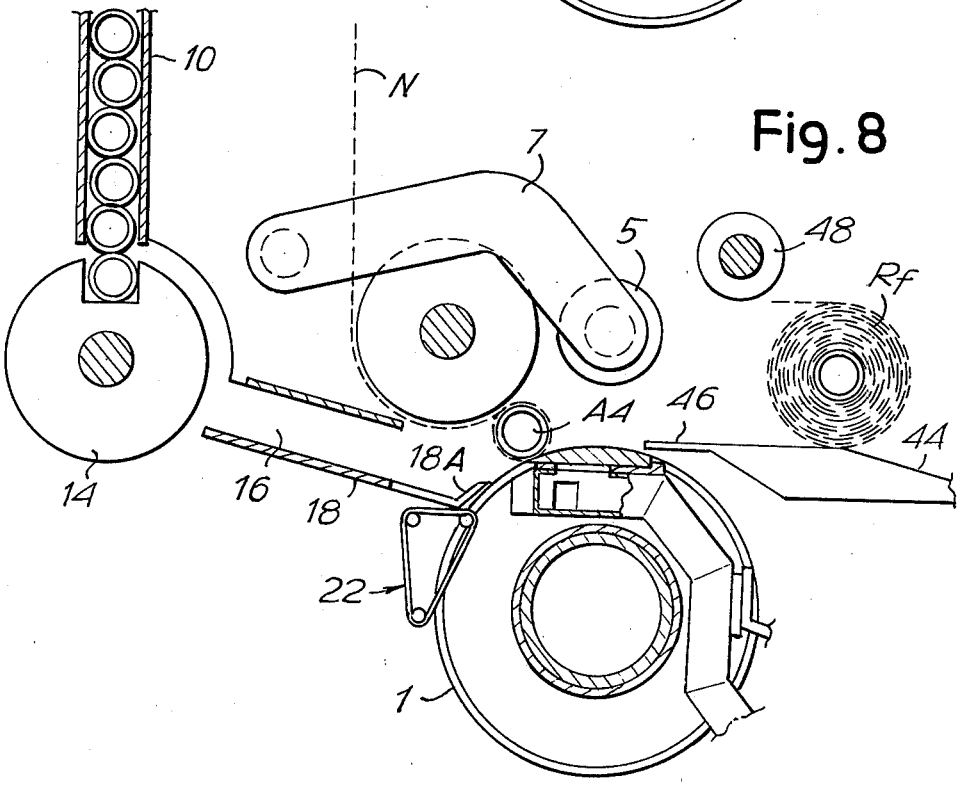

The rig 22 of the belts 24 is set back as shown in FIG. 8, and thereby one returns to the position of FIG. 1, to resume the cycle without stopping the feed of web N. The suction from the orifices 30 ceases as soon as the entrance of the starting end of the web is between drum 1 and the core in position A4 and also between this core and the belts 24. The presser drum 5 is lowered until it makes contact with the core in position A4 to resume the roll winding cycle. The rig 44, 46 is moved backwardly that is, in a direction contrary to arrow f14.

It is understood that the drawing shows only an exemplification given only as a practical demonstration of the invention, which invention can vary in its forms and arrangements without thereby going outside the scope of the idea underlying it. For example, instead of belts 24, a thrust unit can comprise roller means or the equivalent. As a limit case there may be provided also an assembly of fixed shaped elements.

Further there may be provided the use of belts which surround drum 1 at suitable depressions thereof, and which are guided by rollers displaceable through the thrust of the core to be inserted.

While specific embodiments of the invention have been shown and described in detail to illustrate the application of the principles of the invention, it will be understood that the invention may be embodied otherwise without departing from such principles.

What is claimed is:

1. A winding device for winding a web on a core for forming a roll comprising:

web feed means for feeding the web at a feed speed;

a first drum rotatable at a peripheral speed substantially equal to the feed speed;

a second drum spaced from said first drum, rotatable at a speed substantially equal to the feed speed and guiding the fed web;

core insert means for inserting a core between said first and second drum; said first and second drums rotating to wind the web on the core to form a roll;

drum drive means connected to said first and second drums for rotating said drums and for slowing one of said drums after a roll has been formed to advance the roll on said one drum;

said inserter means being operable to insert a new core between said first and second drums when the roll is advanced with web extending between the roll and the new core;

web tear means associated with said first and second drums for tearing the web between the roll and the core;

said drum drive means being operable to increase the slowed rotation of said one drum to the feed speed to wind web on the new core;

said web tear means comprises one of said drums including at least one annular seat, a perforated covering over said seat and suction means for creating a vacuum in said seat to draw therein through perforations of said perforated covering in the vicinity of the web extending between the roll and the core to tear the web extending between the roll and the core.

2. A winding device for winding a web on a core for forming a roll comprising:

web feed means for feeding the web at a feed speed;

a first drum rotatable at a peripheral speed substantially equal to the feed speed;

a second drum spaced from said first drum, rotatable at a speed substantially equal to the feed speed and guiding the fed web;

core insert means for inserting a core between said first and second drums; said first and second drums rotating to wind the web on the core to form a roll;

drum drive means connected to said first and second drums for rotating said drums and for slowing one of said drums after a roll has been formed to advance the roll on said one drum;

said inserter means being operable to insert a new core between said first and second drums when the roll is advanced with web extending between the roll and the new core;

web tear means associated with said one drum for tearing the web between the roll and the core and for drawing the web between the roll and the core into a position between the core and said one drum;

said drum drive means being operable to increase the slow rotation of said one drum to the feed speed after the web between the roll and the core is drawn between the core and said one drum to wind web on the new core.

3. A device according to claim 1 or 2, wherein said first and second drums are spaced by substantially the diameter of the core, and including a presser drum rotatable at a peripheral speed substantially equal to the feed speed and movable on the roll as it is formed, and presser drum mounting means for rotating and moving said presser drum.

4. A device according to claim 3, wherein said means mounting said presser drum comprise an arm for rotatably receiving said presser drum which is pivotaly mounted to permit movement of said presser drum on the roll as the roll is formed.

5. A device according to claim 1 or 2, wherein said core inserter means comprises a core feeder for feeding one core at a time toward said first and second drum and a core pusher for pushing a fed core between said first and second drums.

6. A device according to claim 5, wherein said pusher means comprises at least one belt and three pulleys mounting said belt, a portion of said belt betweeen two of said three pulleys being abuttable against a core and said pusher means being movable to move said core between said first and second drums.

7. A continuous winding device for winding a web on a core to form a spool comprising: a first drum drivable at a peripheral speed equal to a speed at which the web to be wound is fed during a winding phase; a second drum spaced from the first drum by a distance corresponding to a diameter of the core for winding the web for the formation of a spool, the second drum being rotated at a peripheral speed equal to that of the first drum and the web being guided along the second drum; means for driving the first and second drums and for temporarily varying the speed of one of the drums during a core replacement phase and for tearing the web; means for inserting a core between the two drums during the core replacement phase; and a displaceable presser drum bearing against the spool being formed and holding the spool between the first and second drums and the presser drum during winding the first drum including at least one annular seat and at least one perforated zone having orifices adapted to exert a suction during a removal of a finished spool and of insertion of a new core, to bring the web back into the zone in which tearing is to take place, and for inserting the web between the drums and the new core, with vacuum means connected to the first drum for exerting suction therein.

8. A device according to claim 7 wherein said means for inserting a core between said first and second drums comprise at least one element protruding into said at least one annular seat to interfere with a surface of the first drum and thus to facilitate the winding of a starting end of the web on the new inserted core.

9. A device according to claim 8, wherein said elements are formed by continuous belts for contacting the core along sections comprised between guide wheels, to insert the core, and mounted to be moved along by the new core just inserted and set in rotation between the drums, or to be driven in the same direction as movement of the new core.

10. A device according to claim 7, wherein the first drum has annular channels partially covered by perforated lips, which delimit gaps from which issue suction ducts connected to the orifices, which are received in the channels; the belts penetrating into the gaps.

11. A device according to claim 7 including a vacuum tank and a valve for controlling the suction from the orifices.

12. A method of winding a web of material on a core comprising supplying a web to a core, rotating the core between two drums which are rotated at a peripheral speed substantially the same as the speed at which the web is supplied, guiding the web around the core to form a roll of web on the core, slowing the rotation of one of the drums to advance the roll, feeding a new core to between the drums and toward the web, carrying the web between the roll and the new core, and attracting the web between the roll and the new core to the drum which is slowed in rotation by suction.

* * * * *